US006076224A

United States Patent [19]

Pacifico et al.

[11] Patent Number: 6,076,224

[45] Date of Patent: Jun. 20, 2000

[54] GOLF BALL CLEANING DEVICE

[76] Inventors: David A. Pacifico, 5841 Topanga Canyon Pl., Woodland Hills, Calif. 91367; Luther D. Green, 17616 Vincennes St., Northridge, Calif. 91325

[21] Appl. No.: 09/354,751

[22] Filed: Jul. 29, 1999

[51] Int. Cl.[7] ..... A47L 25/00; A41D 13/00

[52] U.S. Cl. ..... 15/210.1; 15/209.1; 2/48

[58] Field of Search ..... 15/209.1, 210.1, 15/104.93; 2/47, 48, 300, 312, 319

[56] References Cited

U.S. PATENT DOCUMENTS

| | | | |
|---|---|---|---|
| D. 290,144 | 6/1987 | Bruce . | |
| 1,702,172 | 2/1929 | Rennie . | |
| 2,209,275 | 7/1940 | Lawrence . | |
| 2,530,746 | 11/1950 | Wetherby . | |
| 2,968,825 | 1/1961 | Wetherby . | |
| 5,147,703 | 9/1992 | Provost | 15/209.1 |
| 5,491,843 | 2/1996 | Naughton | 2/48 |
| 5,639,532 | 6/1997 | Wells | 15/209.1 |
| 5,724,698 | 3/1998 | Mondragon . | |

*Primary Examiner*—Randall E. Chin
*Attorney, Agent, or Firm*—Jack C. Munro

[57] ABSTRACT

A golf ball cleaning device which includes a sheet material casing which has attached thereto a short length of towel. The casing is to be capable of being movable between a folded position and a stretched-out position. Within the folded position, the casing is to be readily attachable to the clothing of a human. When in the folded position, a handle can be grabbed by the user and move the golf ball cleaning device to the stretched-out position which will expose the towel to then be used for cleaning of a golf ball.

7 Claims, 2 Drawing Sheets

GOLF BALL CLEANING DEVICE

BACKGROUND OF THE INVENTION

1) Field of the Invention

The present invention relates to a golf ball cleaning device and more particularly to a golf ball cleaning device that can be mounted and carried on the clothing of a golfer.

2) Description of the Prior Art

In the past, various items have been designed for providing a convenient device for cleaning the dirt off a golf ball. Golf ball cleaners are generally provided at each golf hole which can be used to thoroughly clean the golf ball. In the past, there has also been provided golf ball cleaning devices that are designed to be carried by the golfer. A common form of such a device would be a pouch-type device that is to be carried by the golfer which is to provide for insertion of the golf ball within the pouch-type device which has been premoistened in order to make some attempt at trying to clean the surface of the golf ball.

One of the most important times that a golf ball is to be cleaned is when the golfer is on the putting green. Putting with a clean golf ball is generally a desirable practice. Golf ball cleaning devices are commonly mounted on the teeing area of the hole and are not located in the area of the putting green thereby making such inconvenient during putting. Therefore, in the past it has been common for golfer's to carry with them a wet towel that is then used to clean the golf ball prior to putting. However, carrying of a towel is a rather cumbersome object in addition to carrying of a putter and possibly carrying of one or two additional clubs, such as pitching wedges. It would be desirable to construct a golf ball cleaning device which could be mounted directly onto the clothing of the golfer and could be used to effectively clean the golf ball prior to putting.

SUMMARY OF THE INVENTION

A golf ball cleaning device which includes a sheet material flexible casing which is basically rectangular in shape. This casing has an exterior surface which includes a belt loop attachment and a handle flap. Mounted interiorly with the casing is a short length of towel with the short length of towel being removably attached to the casing for the purpose of moistening and laundering. The casing can be folded upon itself assuming a halved size position with the towel being folded upon itself. With the casing in the folded position a fastening means is engaged. Pulling on the handle flap will disengage the ends of the casing and permit the device to assume a stretched out configuration exposing the towel.

The primary objective of the present invention is to construct a convenient device for cleaning of a golf ball with this device capable of being carried on the person of the golfer and made readily available for instant usage.

Another objective of the present invention is to construct a golf ball cleaning device which can be manufactured at an inexpensive cost and thereby sold to the ultimate consumer at an inexpensive cost.

Another objective of the present invention is to construct a golf ball cleaning device wherein the towel that is used in conjunction with the device can be readily removed from the device for purposes of moistening and laundering thereby facilitating reusage of the device.

DETAILED DESCRIPTION OF THE PREFERRED EMBODIMENT

Figure 1:
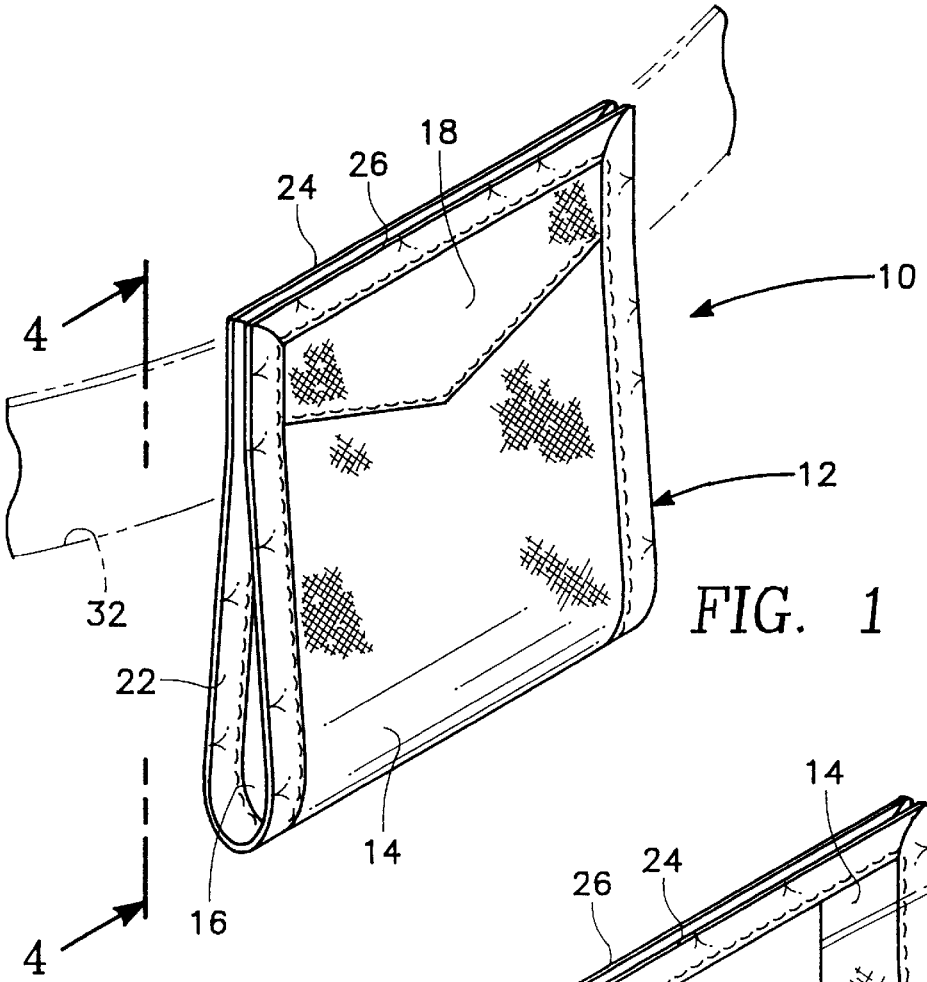
FIG. 1 is a front isometric view of the golf cleaning device of the present invention showing the golf ball cleaning device in the folded position, which is the storage position, as it would normally be mounted on the clothing of a golfer.

Referring particularly to the drawings, there is shown the golf ball cleaning device 10 of this invention. The device 10 includes a sheet material, flexible casing 12. This casing 12 is shown to be of rectangular configuration. However, any other desirable shape could be utilized. The casing 12 is normally constructed of a waterproof plastic or fabric material. Casing 12 has an exterior surface 14 and an interior surface 16. Mounted on the exterior surface 14 is a handle flap 18 and a belt loop 20. The belt loop 20 is fixedly attached to edge seam 22 at lower end 24 of the casing 12. The handle flap 18 is fixedly also mounted to the edge seam 22 at the upper end 26 of the casing 12. It is to be understood that the edge seam 22 is to extend entirely around the periphery of the casing 12. It is to also be understood that the belt loop 20 will normally be constructed of a fabric or plastic material which is also the case for the handle flap 18. Generally, the belt loop 20, the handle flap 18 and the casing 12 are constructed of the same material.

The lower end of the belt loop 20 includes a fastening pad 28. A similar fastening pad 30 is mounted onto the exterior surface 14 of the casing 12. The fastening pads 28 and 30 are constructed with one pad being composed of tiny hooks and the other pad being constructed of tiny eyelets. These fastening pads are in common usage and are commonly sold under the tradename of Velcro. The outer end of the belt loop 20 can be readily disconnected from the exterior surface 14 of the casing 12 which will permit the belt loop 20 to be passed along the inside surface of a belt 32 which is to be worn around pants or shorts that are worn by the golfer. After connection with the belt 32 which will locate the belt 32 between the belt loop 20 and the exterior surface 14, the fastening pads 28 and 30 are then reengaged. It is to be understood that in order to remove the device 10 of this invention from connection with the belt 32, it is only necessary to disengage the fastening pads 28 and 30 which will permit such disengagement.

Figure 3:
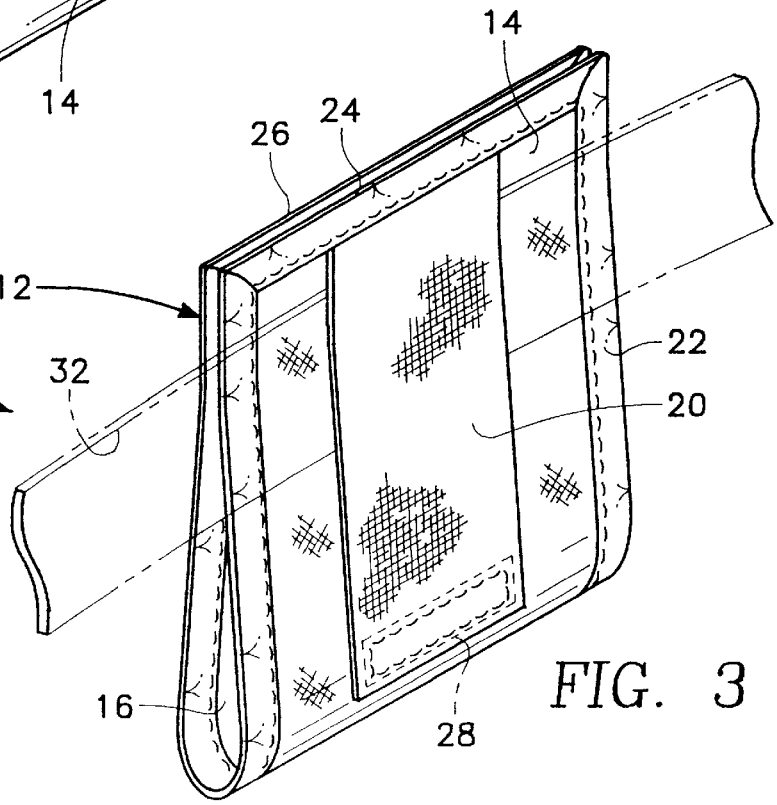
FIG. 3 is a back isometric view of the golf cleaning device of the present invention when it is in the folded position.
Figure 4:
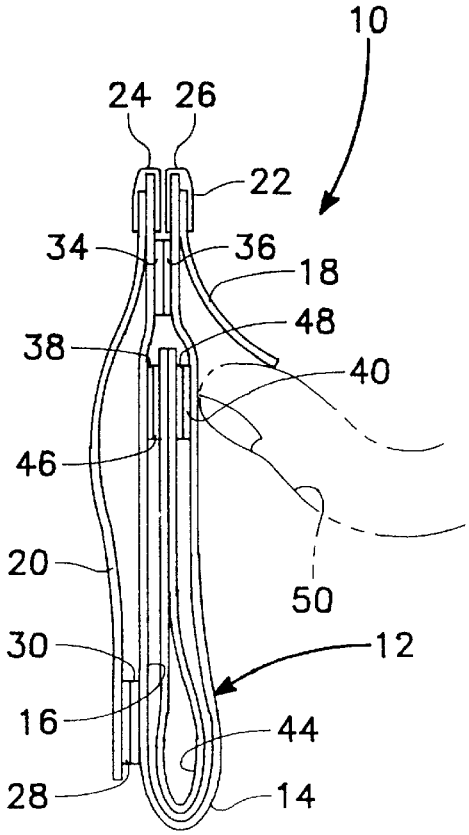
FIG. 4 is a side view of the golf ball cleaning device taken along line 4—4 of FIG. 1 depicting movement of the device from the folded position to the stretched-out position.

Mounted on the interior surface adjacent the lower end 24 is a fastening pad 34. A similar fastening pad 36 is mounted also on the interior surface 16 directly adjacent the upper end 26. The fastening pads 34 and 36 are to be engaged when the casing 12 is folded over upon itself, as shown in FIGS. 1, 3 and 4 of the drawings. The position shown in FIGS. 1, 3 and 4 is the position in which the device 10 is mounted on the belt 32 and is being stored.

Also mounted on the interior surface 16 directly adjacent the fastening pad 36 is another fastening pad 38. A still further fastening pad 40 is fixedly mounted onto the interior surface 16 directly adjacent the fastening pad 34. A towel 44 has an exterior surface and an interior surface, and on the interior surface there is mounted a pair of spaced apart fastening pads 46 and 48. Fastening pad 46 is to connect with fastening pad 38 and fastening pad 48 is to connect with fastening pad 40. The towel 44 is then removably attached to the casing 12. This permits the towel 44 to be removed for the purpose of moistening and laundering.

Figure 2:
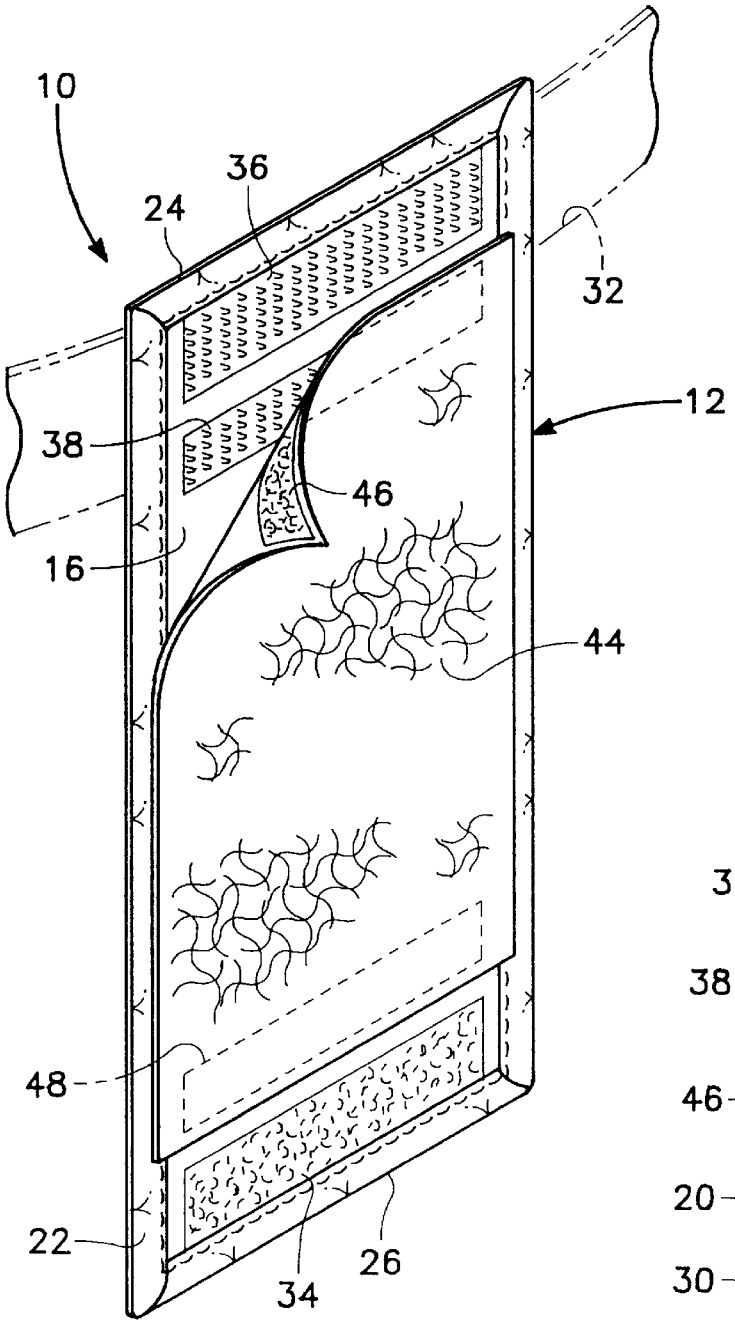
FIG. 2 is an isometric of the golf ball cleaning device of the present invention showing the golf ball cleaning device in the stretched-out position which would be its normal usage position to clean a golf ball.

The operation of the device 10 of this invention is as follows: The device 10 is to be attached, as previously discussed, on the clothing of the user, as by being attached by the belt loop to a belt 32. However, it is to be considered to be within the scope of this invention that instead of a belt loop 20 being utilized, there may be employed a rigid member that could be extended in between the belt area of the pants and the user's body. This alternate form of attachment would be used primarily with pants that do not have belt loops. When the user desires to clean a golf ball, the user is to take a finger 50 and lift the handle flap 18. The user then grasps the handle 18 and pulls such outwardly disengaging fastening pads 34 and 36. This will permit the casing 12 to be moved to the stretched-out configuration shown in FIG. 2. The user can then take a golf ball and wipe against the towel 44 which, in all probability, will be wetted. After cleaning of the golf ball, the user is to merely grab the lower end of the casing 12 and move such to the folded (storage) position again reengaging fastening pads 34 and 36.

What is claimed is:

1. A golf ball cleaning device to be used to clean a golf ball comprising:

a sheet material casing having an exterior surface and an interior surface;

attachment means mounted on said exterior surface, said attachment means to facilitate mounting of said casing onto clothing worn by a human;

a first fastener arrangement mounted on said interior surface, said first fastener arrangement to be engaged when said casing is folded upon itself with said interior surface in juxtaposition, said first fastener arrangement being disengageable permitting said casing to assume a stretched-out position; and a towel mounted by second fastening means to said interior surface, whereby with said casing in said stretched-out position a golf ball can be swiped against said towel for the purpose of cleaning the golf ball.

2. The golf ball cleaning device as defined in claim 1 wherein:

said sheet material casing being of a rectangular shape when in said stretched-out position.

3. The golf ball cleaning device as defined in claim 1 wherein:

said attachment means comprising a belt loop, said belt loop including a third fastener, said third fastener to be disengageable to permit connection of said belt loop onto a belt worn by a human.

4. The golf ball cleaning device as defined in claim 1 wherein:

said first fastener arrangement comprising a pair of spaced-apart fastening pads with one of said fastening pads being mounted at an upper end of said casing and the remaining said fastening pad being mounted at a lower end of said casing.

5. The golf ball cleaning device as defined in claim 1 wherein:

said second fastening means being disengageable to permit said towel to be removed for moistening and laundering.

6. The golf ball cleaning device as defined in claim 1 including:

handle means attached to said exterior surface of said casing, said handle means facilitating moving of said casing from said folded position to said stretched-out position.

7. The golf ball cleaning device as defined in claim 6 wherein: said handle means comprising a sheet material flap.

* * * * *